US006161550A

United States Patent [19]

Kontos

[11] Patent Number: 6,161,550

[45] Date of Patent: Dec. 19, 2000

[54] CIGAR HOLDER WITH CUTTER

[76] Inventor: George Vlasios Kontos, 3909 Lake Des Allemands, Harvey, La. 70058

[21] Appl. No.: 09/390,743

[22] Filed: Sep. 7, 1999

[51] Int. Cl.[7] ..... A24F 13/24; A24C 1/24; B65D 69/00

[52] U.S. Cl. ..... 131/250; 131/188; 131/253; 131/254; 131/248; 131/252; 131/233; 131/255; 30/109; 30/111; 206/238

[58] Field of Search ..... 131/329, 187, 131/188, 253, 254, 248, 250, 252, 233, 255; 30/109, 111, 112, 113; 206/238, 265, 276

[56] References Cited

U.S. PATENT DOCUMENTS

| | | |
|---|---|---|
| 61,234 | 1/1867 | Myers et al. . |
| 486,004 | 11/1892 | Ullin . |
| 666,781 | 1/1901 | Urick . |
| 798,341 | 8/1905 | Hill . |
| 1,025,484 | 5/1912 | Schwieger . |
| 1,249,105 | 12/1917 | Johnson . |
| 1,305,467 | 6/1919 | Hilpert . |
| 1,598,112 | 8/1926 | Bauda . |
| 1,627,790 | 5/1927 | Macorn et al. . |
| 2,664,091 | 12/1953 | Thostenson . |
| 4,907,604 | 3/1990 | Beloff . |
| 5,377,696 | 1/1995 | Goldman ..... 131/248 |
| 5,862,809 | 1/1999 | Nicortral . |

FOREIGN PATENT DOCUMENTS

| | | |
|---|---|---|
| 660223 | 6/1965 | France . |
| 513628 | 11/1930 | Germany . |
| 602 | 12/1866 | United Kingdom . |
| 26741 | 11/1896 | United Kingdom . |

*Primary Examiner*—James Derrington
*Assistant Examiner*—Dionne A. Walls
*Attorney, Agent, or Firm*—Keaty Professional Law Corporation

[57] ABSTRACT

The invention relates to a cigar holder provided with a detachable tip-cutting knife and a plug-removing member inside a cap of the holder. The knife has an inwardly extending portion and exterior portion hinged together and secured within a slot formed in the cap. The exterior portion lies flat in the recess formed in the cap, while the interior portion extends perpendicularly to the exterior portion, transversely to the cap opening. The plug-removing member is fixedly attached to the interior of the cap. It is adapted to pierce through the end of the cigar and remove a small portion of the cigar thereby forming a distinct channel for penetration of the tobacco smoke to the end of the cigar.

12 Claims, 1 Drawing Sheet

10
52
12
14
36
42
38
18

52
40
20
26
16
28
36
42
38
22
18

14
46
50
48
34
36
42
24
22
58

14
54
30
32
42
24
22
58

22
56

CIGAR HOLDER WITH CUTTER

BACKGROUND OF THE INVENTION

This invention relates to a cigar holder, and more particularly to a cigar container equipped with a means for cutting a cigar tip.

In recent years, cigar use has increased dramatically in comparison with even 10 years before. Both men and women, people of different ages engage in this past time; cigar aficionados can be found almost anywhere in the world.

Some of the best cigars are conventionally sold in wooden boxes, each individually wrapped in cellophane to retain moisture and freshness of the cigar. Very high quality cigars are sold individually encased in a cigar-shaped container, where they are protected from the environment until ready for use by the consumer.

Cigar smokers usually test the freshness of the cigar by rolling it between the fingers to make sure that the cigar is pliable and therefore, in top condition for smoking. If the cigar is of the quality desired by the consumer, he/she cuts off one tip of the cigar to make the cut end of the cigar more penetrable to smoke inhaled by the user.

Various devices have been devised for cutting the tip of the cigar. These devices may be in the shape of a knife, scissors, etc. The goal is, of course, to prevent fraying of the cut end of the cigar and make it less convenient for holding in the smoker's mouth.

Some of the known devices incorporate the cigar cutter directly into an individual cigar container. Most of the prior cigar cutter/container devices have been designed for use with non-portable containers.

One such device is disclosed in U.S. Pat. No. 61,234 issued on Jan. 15, 1867 to Myers et al. There, two portions of a cigar tube are held by a spring in a telescopic relationship. When the two portions are held in a spaced apart relationship to each other, a cigar end is extended through an orifice, where it is cut by a knife incorporated into the device.

Another example is shown in U.S. Pat. No. 486,004 issued on Nov. 8, 1892 to Ullin where semicircular portions of a cigar case are hinged together along one side. A plurality of knives, or cutters is provided inside the cigar case. When the portions of the case are closed, the knives sever the burnt end of the cigar leaving the remainder of the cigar intact.

Still another example is shown in U.S. Pat. No. 1,025,484 issued on May 7, 1912 to Schwieger, where a cigar cutter is built into a case. The cutting knife in that patent is a slotted lever positioned near the tongue engaged in the slot. The lever has a catch that engages the lid of the case; it slides pivotally to cut an end of the cigar.

U.S. Pat. No. 1,598,111 issued on Aug. 31, 1926 to Bauda discloses a cigar holder with a cutter formed as a knife gauge. The knife is pivoted to one end of the cigar holder section, with the other end having a handle that forms a spring clip.

Several patents were issued for using a cigar cutter built into a holder for cutting off used portion of the cigar and retaining the unsmoked portion of the cigar in the case for future use. Such devices are shown in, for example, U.S. Pat. No. 2,664,091 issued on Dec. 29, 1953 to Thorstenson and in U.S. Pat. No. 4,907,604 issued on Mar. 13, 1990 to Beloff. German Patent No. 503638 issued on Mar. 27, 1929 to Schneider discloses a cigar cutter built into a cigar case.

While this list is not exhaustive, it illustrates the developments in the field of cigar holders or cases that are combined with a cigar cutter that eliminates the need for carrying a special clipper or knife in one's pocket to cut the end of a cigar.

While these devices work in satisfactory manner under certain conditions, there exists a need for a portable cigar holder or case with a built-in cigar cutter that is easy to use and inexpensive to manufacture.

SUMMARY OF THE INVENTION

It is, therefore, an object of the present invention to provide a portable cigar holder with a built-in cigar cutter.

It is another object of the present invention to provide a cigar holder with a knife that is built into a cap of a cigar and can be used with one hand of the user.

It is a further object of the present invention to provide a cigar holder with a plug remover for extracting a plug from an end of a cigar so as to decrease the surface for smoke penetration.

These and other objects of the present invention are achieved through a provision of a cigar holder comprised of a cap threadably engaged with a main body of the cigar holder. A transverse slot is made in the cap to accommodate a cigar cutting knife that extends transversely to the longitudinal axis of the cap inside the holder. A second portion of the knife is hingedly attached to the interior portion, and when the knife is not in use, lies flat inside a recess formed in the cap.

The tip of the cigar is cut when the knife is first removed from the cap, the cigar end is brought to extend to the interior chamber formed by the cap and the knife is then forced inside the cap cutting off the tip of the cigar.

A plug removing member comprises a cylindrical tube cut straight or at an angle to form a sharp penetrating point. The plug removing member is fixedly attached inside the closed end of the cap. The plug removing member pierces the end of the cigar and, when withdrawn, removes a portion of the tobacco leaves forming the round tip of the cigar. This action forms a distinct channel, allowing better smoke penetration to the unlit end of the cigar.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figures 1, 2, 3, 4, 5:
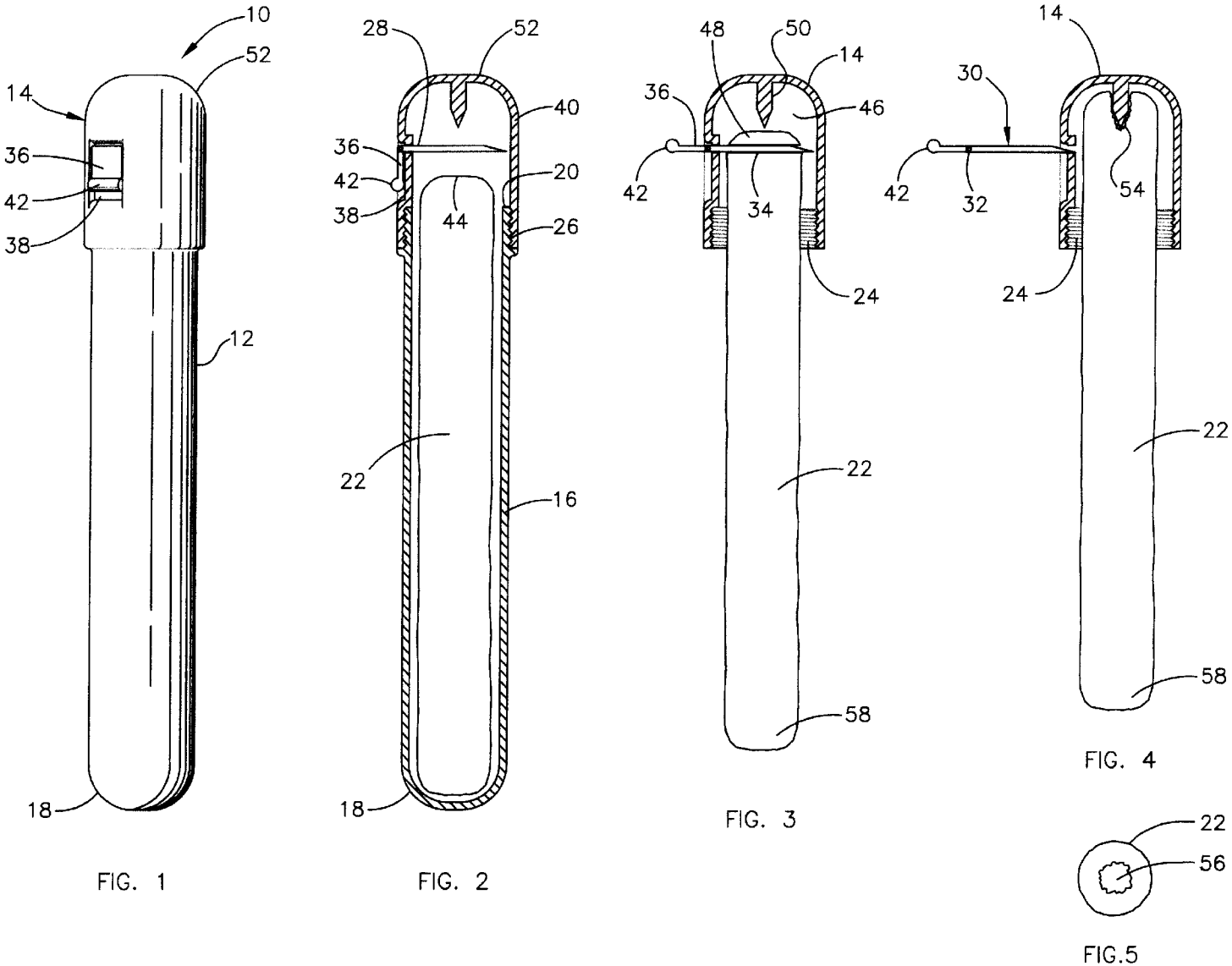
FIG. 1 is a perspective view of the cigar holder in accordance with the present invention.
FIG. 2 is a cross-sectional view of the cigar holder.
FIG. 3 is a detail view showing the cutter knife cutting the tip of a cigar.
FIG. 4 is a detail view showing the plug-removing member penetrating one end of the cigar.
FIG. 5 is a detail top view showing a smoke channel formed by the plug-removing member in the cigar end.

Turning now to the drawings in more detail, numeral 10 designates the cigar holder in accordance with the present invention. The holder, or container 10 comprises a main body 12 and a cap 14 of a size and shape to accommodate an individual cigar. It is preferred that the holder 10 be relatively slim so as to comfortably fit in a coat pocket or purse of the user, although the nature of the present invention does not depend on the particular size of the cigar holder 10.

The main body 12 is generally a cylindrically-shaped hollow body having a cylindrical wall 16 and a rounded closed bottom 18. The top edge 20 of the hollow body 12 defines an open top through which a cigar 22 extends.

The cap 14 is provided with internal threads 24, as can be better seen in FIGS. 3 and 4, formed adjacent the lower part of the cap 14. The threads 24 are adapted to engage mating threads 26 formed on the exterior upper portion of the hollow body 12, as can be seen in FIG. 3. When the cap 14 is engaged with the main body 12, the cap 14 prevents the cigar 22 from falling out through the open end of the body 12.

A narrow slot, or opening 38 is formed in the cap 14 transversely to a longitudinal axis thereof. Fitted within the slot 28 is a cigar-cutting member 30. The cigar-cutting member, or knife 30 is composed of two sections, joined by a hinge 32. A sharpened first portion 34 of the cutting member 30 extends inside the cap 14 transversely to the longitudinal axis of the cap 14 in a manner shown in FIG. 2.

The second portion 36 normally extends at a right angle to the portion 34 and lies flat inside a recess 38 formed in the exterior wall 40 of the cap 14. When the cap 14 is secured to the main body 12, the second portion 36 is oriented in a general alignment to the exterior wall 40 of the cap 14.

A gripping tip 42 is formed on the lower part 46 of the second portion 36. The gripping tip 42 allows the user to grasp the tip 42 by fingers or nails and move the second knife portion 36 upwardly against the hinge 32 and align the portion 36 with the portion 34, as can be better seen in FIG. 3.

Generally, the cap 14 is of sufficient size to extend above the end 44 of the cigar 22, such that the portion 34 of the cutting member 30 does not interfere with the cigar 22 and does not fray or damage its end 34. When the cigar tip needs to be cut, the cap 14 is disengaged from the body 12; the cap 14 is then held in one hand of the user. The user then lifts the portion 36 of the knife 30 to form a straight cutting member 30. The hinge 32 is locked, preventing return of the second portion 36 to its perpendicular position in relation to the first portion 34.

The user then pulls the cutting knife 30 partially from the cap 14 and extends the cigar 22 into the hollow chamber 46 formed by the cap 14. The cigar 22 is preferably extended to align the end of the cigar across from the slot 38 in the cap 14.

The knife 30 is then pushed inside the cap 14, cutting off a tip 48 of the cigar. The cigar is then withdrawn, and a tip 48 is disposed of, while the cutting member 30 is returned to its normal position inside the cap 14, similar to position shown in FIG. 2. When a new cigar is placed in the holder 10, the process of cutting the tip 48 of the cigar 22 can be repeated again an indefinite number of times.

Some of the cigar smokers, in order to decrease the smoke-penetrating surface and enhance the permeability of the smoke make a puncture through the tip of the cigar. It is believed that the puncture forms a channel through which the smoke has a better ability to permeate and reach the unlit end of the cigar.

To this end, various pins or stilettos have been used to puncture the top end of the cigar. Some of the known cigar holders are provided with a built-n puncture pin that extends from the interior of the cigar holder. However, a simple puncture, as a general rule, creates only a very small opening that oftentimes closes under the elasticity forces acting on the tobacco leaves rolled into a cigar.

The present invention overcomes this shortcoming by providing a plug-removing member 50 fixedly attached to the inner top wall 52 of the cap 14. The plug removing member 50 is a hollow cylindrical tube that can be cut straight or at an angle to form a sharpened point 54, as shown in the drawings or a sharp edge (not shown). When the user wishes to create an opening or channel inside the top portion 44 of the cigar 22, the user disengages the cap from the main body 12, removes the knife 30 from its slot 28 and moves the top end of the cigar 22 into the chamber 46. By pushing the cigar all the way inside the cap 14, the user is able to force the plug removing member 50 into the end 44 of the cigar 22.

When the cigar 22 is withdrawn from the cap 14, a distinct opening or smoke channel 56 (FIG. 5) is formed in the cigar body 22. The opening 56 often has uneven edges but is wide enough not to close under the elasticity of the tobacco leaves.

The plug, or small amount of tobacco leaves that is retrieved by the member 50 is shaken off from the cap 14, and the knife 30 is returned to its original position inside the cap 14 for future use. The hole formed by the plug-removing member 50 facilitates a flow of smoke from the lit end 58 of the cigar 22 and delivery of that flow of smoke to the end 44.

If desired, the main body 12 can be formed as a packet of individual holders secured together by molding or by welding, each cylindrical section being formed to accommodate an individual cigar. The knife cutting member 30 is such a case may be incorporated into a side of a cap and several cigars can be cut using the same cutting knife 30, or it can be provided in every cap, depending on the manufacturer's preference.

The holder 10 is preferably made from a lightweight material to facilitate portability of the holder. The plug-removing member 50, similarly, can be made from the same material as the cap 14 and can be molded together with the cap 14 or fixedly attached, such as by welding or a glue to the inside of the cap 14 in a general center thereof to extend in co-alignment with the longitudinal axis of the cap 14.

Many changes and modifications can be made in the design of the present invention without departing from the spirit thereof. I, therefore, pray that my rights to the present invention be limited only by the scope of the pending claims.

I claim:

1. A cigar holder, comprising:

a hollow cigar-shaped body having a closed bottom and an open top;

a hollow cap threadably engageable with the top of said body, said cap being provided with a cigar tip cutting member detachably slidably secured within a slot formed in said cap, said cigar tip cutting member comprising a first portion extending transversely inside said cap and a second portion hingedly attached to said first portion, said second portion being mounted outside of said cap.

2. The cigar holder of claim 1, further comprising a plug removing means for removing a portion of a cigar end.

3. The cigar holder of claim 2, wherein said plug removing member comprises a hollow cylindrical member with a sharpened tip for penetrating an unlit end of the cigar and withdrawing a portion of the cigar, thereby forming a channel for increased flow of smoke to the cigar end.

4. The cigar holder of claim 1, wherein said cap is formed with a recess in an outer wall, and wherein the second portion of said cigar tip cutting member fits substantially entirely within said recess when said cap is engaged with said hollow body.

5. The cigar holder of claim 1, wherein said second portion of said cigar tip cutting member is provided with a gripping tip allowing manual engagement of said second portion and movement of said cigar tip cutting member in relation to said cap.

6. The cigar holder of claim 1, wherein said second portion of said cigar tip cutting member is normally mounted perpendicularly in relation to said first portion of the cigar tip cutting member, said second portion being adapted for movement along a hinge line and general alignment with said first portion when said cigar tip cutting member cuts off a tip of a cigar.

7. A cigar holder, comprising:

a hollow cigar-shaped body having a closed bottom and an open top;

a hollow cap threadably engageable with the top of said body, said cap being provided with a cigar tip cutting member detachably slidably secured within a slot formed in said cap, said cigar tip cutting member comprising a first portion extending transversely inside said cap and a second portion hingedly attached to said first portion, said second portion being mounted outside of said cap in a recess formed in an exterior wall of said cap; and a plug removing means for removing a portion of a cigar end.

8. The cigar holder of claim 7, wherein said second portion of said cigar tip cutting member is provided with a gripping tip allowing manual engagement of said second portion and movement of said cigar tip cutting member in relation to said cap.

9. The cigar holder of claim 2, wherein said plug removing member comprises a hollow cylindrical member with a sharpened edge for penetrating an end of the cigar and withdrawing a portion of the cigar, thereby forming a channel for a flow of smoke to the cigar end.

10. A method of cutting a tip of a cigar, the method comprising the following steps:

providing a cigar holder, comprising a hollow cigar-shaped body having a closed bottom and an open top, a hollow cap threadably engageable with the top of said body, said cap being provided with a cigar tip cutting member detachably slidably secured within a slot formed in said cap, said cigar tip cutting member comprising a first portion extending transversely inside said cap and a second portion hingedly attached to said first portion, said second portion being mounted outside of said cap in a recess formed in an exterior wall of said cap;

detaching the cap from said body;

gripping the second portion of the cigar tip cutting member and sliding the cigar tip cutting member outwardly from said cap;

positioning an unlit end of a cigar within said cap such that a tip of the cigar extends into said cap; and pushing said cigar tip cutting member across an interior of said cap, thereby cutting the tip of the cigar.

11. The method of claim 10, further comprising a step of forming a channel for a flow of smoke to the end of the cigar.

12. The method of claim 11, wherein said step of forming the channel comprises the steps: providing a plug removing member securely attached to an interior wall of the cap and extending into said cap;

moving said plug removing member into an engagement with said end f the cigar; and withdrawing said plug removing member from said end of the cigar and removing a portion of the cigar, thereby forming the channel for a flow of smoke to the end of the cigar.

* * * * *